US007114437B2

(12) United States Patent
Kolbe et al.

(10) Patent No.: US 7,114,437 B2
(45) Date of Patent: Oct. 3, 2006

(54) METHOD AND APPARATUS FOR SHIFTING A DOCTOR BLADE

(75) Inventors: Wilfried Kolbe, Gülzow (DE); Bodo Steinmeier, Bielefeld (DE); Andreas Kückelmann, Ibbenbüren (DE); Klaus Schirrich, Bielefeld (DE); Ralf Mulch, Bad Salzuflen (DE)

(73) Assignee: Fischer & Krecke GmbH & Co., Bielefeld (DE)

( * ) Notice: Subject to any disclaimer, the term of this patent is extended or adjusted under 35 U.S.C. 154(b) by 45 days.

(21) Appl. No.: 10/985,669

(22) Filed: Nov. 10, 2004

(65) Prior Publication Data

US 2005/0120894 A1 Jun. 9, 2005

(30) Foreign Application Priority Data

Nov. 14, 2003 (EP) ..... 03025990

(51) Int. Cl.
*B41F 9/10* (2006.01)

(52) U.S. Cl. ..... 101/169; 101/157

(58) Field of Classification Search ..... 101/169, 101/167, 157, 350.3, 363–366; 15/256.51, 15/256.53

See application file for complete search history.

(56) References Cited

U.S. PATENT DOCUMENTS

| | | | | |
|---|---|---|---|---|
| 3,087,184 | A * | 4/1963 | Ljungquist | 15/256.51 |
| 3,964,386 | A * | 6/1976 | Dini | 101/169 |
| 4,111,545 | A * | 9/1978 | Meltzer | 399/351 |
| 5,226,364 | A * | 7/1993 | Fadner | 101/366 |
| 6,203,962 | B1 * | 3/2001 | Itami et al. | 430/125 |
| 6,431,066 | B1 | 8/2002 | Perez et al. | 101/350.6 |
| 6,732,644 | B1 * | 5/2004 | Frankenberger | 101/350.3 |
| 6,752,077 | B1 | 6/2004 | Kolbe et al. | 101/169 |
| 2002/0162466 | A1 * | 11/2002 | Schonberger | 101/350.3 |

FOREIGN PATENT DOCUMENTS

| | | |
|---|---|---|
| DE | 512 135 | 2/1932 |
| DE | 749 890 | 1/1945 |
| DE | 1 038 066 | 9/1958 |
| EP | 0 182 326 | 5/1986 |
| EP | 0 515 747 | 12/1992 |
| EP | 0 663 290 | 7/1995 |
| FR | 1 396 328 | 4/1965 |

* cited by examiner

*Primary Examiner*—Anthony H. Nguyen
(74) *Attorney, Agent, or Firm*—Richard M. Goldberg

(57) ABSTRACT

A method for shifting a doctor blade in its longitudinal direction, the doctor blade being set against a cylinder of a printing machine, wherein the shift movement of the doctor blade is such that, for most of the time of the print operation, the shift velocity of the doctor blade is in a range from 0 to 0.1 m/s, and a printing machine having a doctor blade assembly, including a doctor blade arranged to be set against a cylinder, and a shift mechanism for shifting the doctor blade in its longitudinal direction, such that the shift mechanism is adapted to execute the method.

15 Claims, 3 Drawing Sheets

METHOD AND APPARATUS FOR SHIFTING A DOCTOR BLADE

BACKGROUND OF THE INVENTION

The invention relates to a method for shifting a doctor blade, that is set against a cylinder of a printing machine, in direction of the longitudinal axis of the doctor blade, as well as an apparatus for carrying out this method.

In printing machines, doctor blade assemblies are generally used for doctoring the surface of a rotating cylinder, e.g. the printing cylinder, by means of a doctor blade. In a gravure printing machine, for example, such a doctor device has the function to wipe the surface of t he gravure printing cylinder after it has been inked and before the proper print process takes place, so that printing ink will remain only in the printing, engraved portions of the printing cylinder surface.

In conventional printing machines, the doctor blades are generally formed by thin sheets of hardened or non-hardened spring steel. An edge of a doctor blade that is set against the surface of the print cylinder or anilox roller, is subject to considerable wear. In order to increase the lifetime of the doctor blade, the doctor blade is oscillated in its longitudinal direction, so that the wear of the doctor blade is distributed as far as possible. The frequency of such an oscillation may for example be 1 Hz or more, depending on the production speed, and the oscillation stroke may for example be as large as 40 mm. Although such an oscillation of the doctor blade distributes the locus of wear, it is still necessary relatively frequently to replace a worn doctor blade. This necessitates a stop of the printing machine.

In order to further reduce the wear of the doctor blade, doctor blades have been used, which have a ceramic coating on the side facing the printing cylinder. This increases the lifetime of the doctor blade to a multiple.

Applicant's European patent application EP 1 362 696 suggests to oscillate the doctor blade with a frequency in the acoustic or ultrasonic range. This measure serves to remove contaminations from the gravure printing cylinder. Here, the stroke of the vibration movement may be less than 0.2 mm.

On the one hand, a lateral oscillation of the doctor blade is desirable in order to avoid an uneven wear of the doctor blade, but on the other hand the oscillation may have a negative effect on the printed image, because differences in the speed of the doctor blade may result in slightly different amounts of ink in the engraved portions of the printing cylinder. With the result that ink is non-uniformly applied onto the medium. Especially the difference between a range where the doctor blade moves with an even speed, and a range where the direction of movement of the doctor blade is reversed, may be visible in the printed image. Since the frequency of the oscillation of the doctor blade is in many cases coupled to the rotary frequency of the printing cylinder, different motion patterns are used for different doctor blades, in quality multi colour printing, for example, in order to prevent the deviations in the individual colours from adding-up. However, in multi colour printing for particularly high quality, the different speeds, directions of movement and direction reversals accompanying the oscillation of the doctor blade may still have a negative effect on the printed image.

SUMMARY OF THE INVENTION

It is an object of the invention to provide a method for shifting a doctor blade set against a cylinder of a printing machine, wherein a high print quality can be achieved with a wear of the doctor blade as uniform and as small as possible, and to provide a printing machine for carrying out this method.

According to the invention, this object is achieved by a method as indicated above, wherein the shift movement of the doctor blade is such that, during most of the time of the print operation, the speed of the shift movement of the doctor blade is in a range from 0 to 0.1 m/s, preferably in a range between 0 and 0.01 m/s. The object is further achieved with a printing machine as indicated in claim 7.

Preferably, the velocity of the shift movement of the doctor blade during most of the time of the print operation is in a range from 0 to 1 mm/s, more preferably in a range from 0 to 0.1 mm/s, and particularly preferred is a range from 0 to 0.01 mm/s.

The velocities indicated above for most of the time of the printing operation may in particular apply to time periods which correspond to 90%, more particularly 99% of the total time of the print operation.

When, during most of the time of the print operation, the doctor blade is shifted with a low velocity or is even held stationary, adverse effects of the movement of the doctor blade on the print quality can be reduced remarkably in comparison to a conventional, more rapid oscillation of the doctor blade. The smaller the velocity of the shift movement is, if it is not zero, the smaller is the effect on the printed image. Nevertheless, a slow but long lasting movement of the doctor blade or an intermittent movement of the doctor blade has the effect that, in the course of time, the doctor blade is shifted by a stroke of several millimetres, so that the wear of the doctor blade is distributed over the stroke length.

The invention avoids a non-uniform wear of the doctor blade and at the same time achieves a particularly high print quality, because the ink is applied very uniformly onto the print medium when the doctor blade is at rest or moves very slowly.

Useful embodiments of the invention are indicated in the dependent claims.

In a first embodiment of the method, the shift movement of the doctor blade is divided in terms of time into motion periods and rest periods, and the length of the rest periods are predominant during the print operation. In particular, the duration of the motion periods may be less than 10% of the duration of the rest periods, preferably less than 1%. It may even be significantly smaller. The duration of the rest periods should preferably be selected such that a noticeable, non-uniform wear of the doctor blade does not yet occur during the rest period. In this embodiment, the uniformity and hence the quality of the printed image is particularly high while the doctor blade is at rest.

In a printing machine, in which the printing medium is drawn from a coil and/or is wound onto a coil, it is known that a coil exchange operation during the continuing print operation leads to a temporary production of waste. This is the case for example, when a spliced section that has been formed in the web of the print medium during an automatic coil exchange passes through the print unit or when a web section is printed on, which must later be severed when a take-up roller is automatically exchanged. Therefore, it is preferable in the method according to the invention that the motion periods of the doctor blade are so timed that they coincide with the production of waste. The irregularities in the printed image that are caused by the movement of the doctor blade will then not impair the quality of the resulting print, because they are removed together with the waste, anyway.

Preferably, the shift movement of the doctor blade is automatically synchronised with the coil exchange operation.

In a second embodiment of the method, the shift movement is a periodic to-and-fro movement with a period of at least 10 seconds, preferably at least 1 minute, more preferably at least 10 minutes. Such a shift movement can be performed continuously during the print operation and will significantly reduce the deterioration of the printed image in comparison to a faster oscillation of the doctor blade. Provided that the doctor blade is sufficiently wear resistant, the period may be substantially longer and may amount to 1 hour, for example. In the second embodiment, the negative effect of the movement of the doctor blade on the printed image is also reduced significantly, and a non-uniform wear is nevertheless avoided.

In both embodiments of the method, the shift movement may be superposed with a vibration movement with a frequency of at least 1 Hz, preferably at least 5 Hz. This vibration movement may also be an acoustic oscillation or a supersonic oscillation. The vibration movement is preferably performed in a longitudinal direction of the doctor blade. Its purpose is among others to remove contaminations from the engraved portions of the cylinder or from the doctor blade, as has been described in applicant's European patent application EP 1 362 696. Especially in the second embodiment, however, the vibration movement has also the purpose to reduce differences in the effect of the doctor blade which occur when the doctor blade comes to rest when the direction of movement is reversed, due to the periodic to-and-fro movement. The movements of the doctor blade that are induced by the vibration are not considered as part of the "shift movement" in the meaning of the invention, and the limits for the velocity as indicated in claim 1 relate only to the shift movement as such, without taking the vibration into account.

Claim 7 relates to a printing machine with a doctor blade assembly having a doctor blade arranged to be set against a cylinder, and a shifting device for shifting the doctor blade in its longitudinal direction, wherein the shifting device is adapted to execute a method according to any of the claims 1 to 4. The shifting device may be adapted for automatic or semi-automatic operation. The printing machine has the advantages that have been described in conjunction with the method.

In a preferred embodiment, the doctor blade assembly of the printing machine has an oscillator for generating a vibration movement of the doctor blade, and the shifting device and the oscillator are adapted to execute a method according to any of the claims 1 to 4, wherein a vibration movement with a frequency of at least 1 Hz, preferably at least 5 Hz, is superposed to the shift movement.

In a particularly preferred embodiment of the printing machine, the doctor blade has a ceramic coating on the side that is subject to wear. This permits a long duration of the rest period in the shift operation of the doctor blade or a periodic to-and-fro movement with a particularly long period, without causing uneven wear of the doctor blade.

BRIEF DESCRIPTION OF THE DRAWINGS

Preferred embodiments of the invention will now be explained in conjunction with the drawings, wherein.

DETAILED DESCRIPTION

Figure 1:
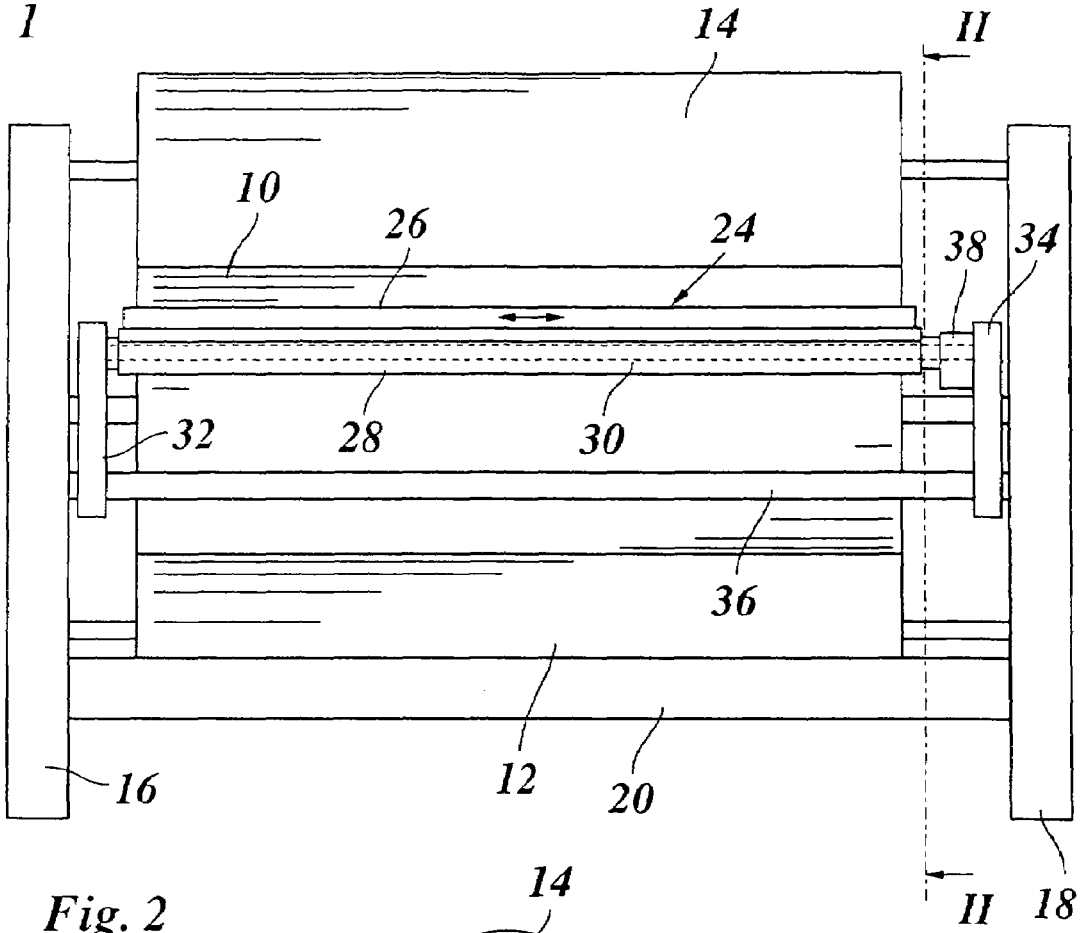
FIG. 1 is a schematic view of a gravure printing machine.

The gravure machine shown in FIG. 1 comprises a gravure printing cylinder 10, an inking roller 12 and a pressure roller 14 which are rotatably supported between side members 16, 18 of a machine frame.

Drive means and adjusting means of the machine have not been shown, because they are not essential for understanding the invention.

Figure 2:
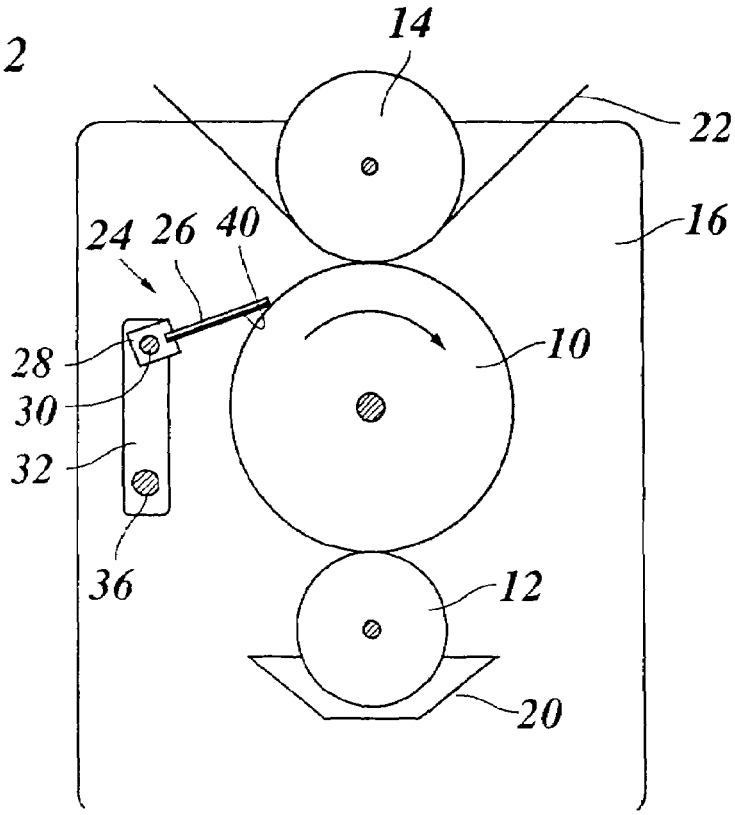
FIG. 2 is a schematic section along the line II—II in FIG. 1.

The inking roller 12 has its top held in engagement with the gravure printing cylinder 10 and has its bottom immersed into an inking trough, as can be seen more clearly in FIG. 2. Thus, the inking roller 12 takes up ink from the inking trough 20 and transfers the ink onto the peripheral surface of the gravure printing cylinder 10 which rotates in the direction of an arrow shown in FIG. 2 and transfers the ink onto a print medium web 22 which passes through between the pressure roller 14 and the printing cylinder and is pressed against the printing cylinder by the pressure roller.

A doctor blade assembly 24 is arranged at the gravure printing cylinder 10. As is known per-se, this doctor blade assembly is formed by a doctor blade 26 mounted to a bracket 28. The bracket is mounted on a shaft 30 which extends between two levers 32 and 34. The lower ends of the levers 32, 34 are held on a rotatable shaft 36 by which the whole doctor blade assembly 24 may be pivoted against the periphery of the printing cylinder, so that the surface thereof is doctored with an edge of the doctor blade 26. In this way, the ink that has been applied by the inking roller 12 is removed from the smooth, non-printing surface areas of the gravure printing cylinder 10, so that the ink will only remain in the engraved portions which create the printed image on the web 22.

Mounted to the lever 34 is a shift mechanism 38 with which the bracket 28 and hence the doctor blade 26 may be shifted relative to the levers 32, 34 in the direction of the longitudinal axis of the doctor blade, as is indicated by a double arrow in FIG. 1. Thus, the shift mechanism 38 is a transverse displacement mechanism which generates a movement of the edge of the doctor blade 26 relative to the gravure printing cylinder 10 in a direction transverse to the direction of transport of the web 22, i.e. in axial direction of the printing cylinder. In place of the shift mechanism 38, there may also be provided a shift mechanism which shifts the whole doctor blade assembly 24, including the levers 32, 34, in the indicated direction.

FIG. 2 shows a ceramic coating 40 on the bottom side of the doctor blade 26, which coating reduces the wear of the doctor blade 26 resulting from contact with the rotating gravure printing cylinder 10.

Figure 3:
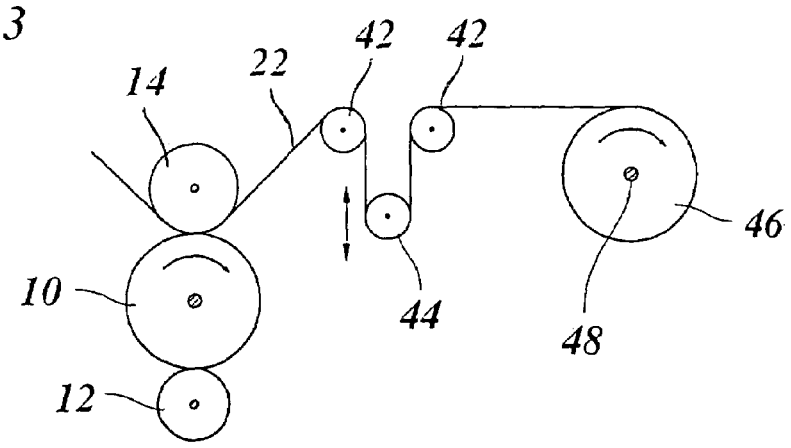
FIG. 3 is a schematic view of a portion of a gravure printing machine having a winder.

As is shown in FIG. 3, the web 22 having passed through the printing machine passes over deflection rollers 42 and a slack-removing roller 44 and is wound onto a coil 46. As is well known in the art, the coil may be replaced automatically or manually by a new drum 48 which will then form a core of the next coil. The bearings for the deflection rollers 42 and the core 46 and associated equipment of the winder have not been shown here, because they are not essential for understanding the invention.

Figure 4:
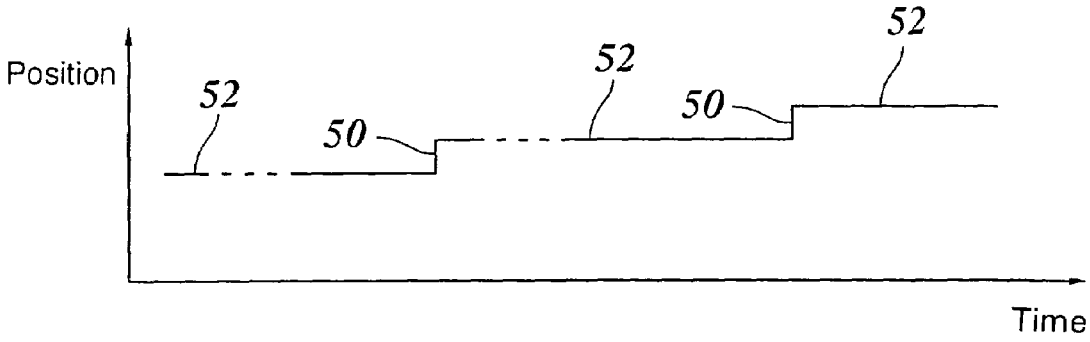
FIG. 4 is a diagram illustrating a shift operation with motion periods and rest periods.
Figure 5:
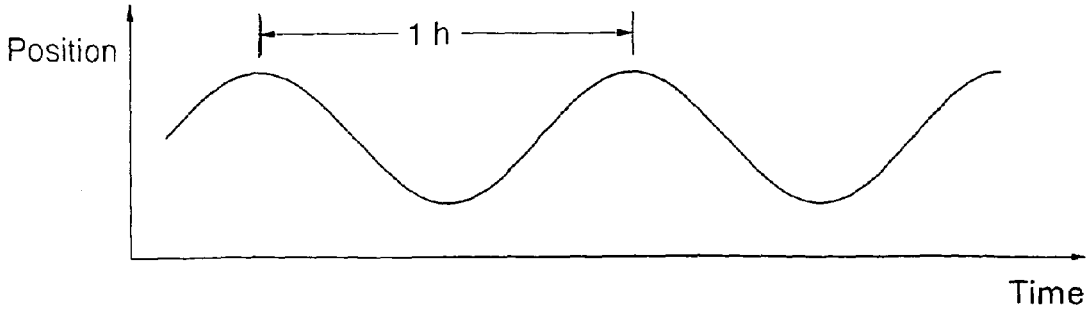
FIG. 5 is a diagram of a periodic to-and-fro movement.

FIGS. 4 and 5 are sketches illustrating two types of shift movement of the doctor blade 26, which may be created by the shift mechanism 38 of the doctor blade assembly 24. The shift movement always takes place in the longitudinal direction of the doctor blade. What is shown is the position of the doctor blade 26 in the direction of the shift movement, which position varies in time. In order to clearly show the differences between the different motion patterns, the diagrams in FIGS. 4 and 5 and also in FIG. 7, which will be described below, are not to scale.

FIG. 4 illustrates a shift operation of the doctor blade 26, which operation is divided into motion periods 50 and rest periods 52. Here, the length of the rest periods 52 is at least 100 times as large as the length of the motion periods 50. During a motion period 50, the doctor blade 26 is shifted by a certain amount in its longitudinal direction. In FIG. 4, two motion periods 50 have been shown, in which the doctor blade 26 is shifted in the like direction and by the like amount of 1 mm, for example. After the doctor blade 26 has been shifted to a predetermined position in several motion periods 50, the direction of the shift movement is reversed. The distance, by which the doctor blade is shifted in the further motion periods, may be varied.

Unlike the example shown in FIG. 4, the distance by which the doctor blade is shifted in one motion period 50 may also be varied when the direction of the movement is not changed. In order to make the wear of the doctor lade 26 as uniform as possible, it is preferable that the distances by which the doctor blade is shifted are varied such that a position which the doctor blade has once assumed will be assumed again only after a time period as long as possible.

The motion periods 50 are coincident in time with the operations of exchanging the coil 46. One coil 46 is wound during each rest period 52. A sensor, which has not been shown, detects the radius of the coil 46 and triggers the motion period 50 when the coil needs to be exchanged. The coil exchange itself is then triggered with such a time delay that, in the course of the coil exchange, the web will be severed approximately at a position which has been printed during the motion period 50. If the movement of the doctor blade 26 has deteriorated the printed image, the defect will consequently be located in a section of the web which forms either the end of the old coil or the start of the new coil and will later be removed as waste, anyway.

FIG. 5 illustrates a motion pattern according to another embodiment. Here, the motion pattern is a periodic to-and-fro movement with a period of 1 hour. The stroke of the oscillation amounts to ±20 mm. for example. The velocity with which the doctor blade 26 is shifted is accordingly in a range from 0 to 0.04 mm/s. This very low velocity will affect the printed image only very little, if at all. Other oscillation patterns are also conceivable, for example, a saw-tooth oscillation.

A further improvement of the printed image can be achieved by means of a vibration movement which is superposed to the shift movement of the doctor blade 26, as will be explained below.

Figure 6:
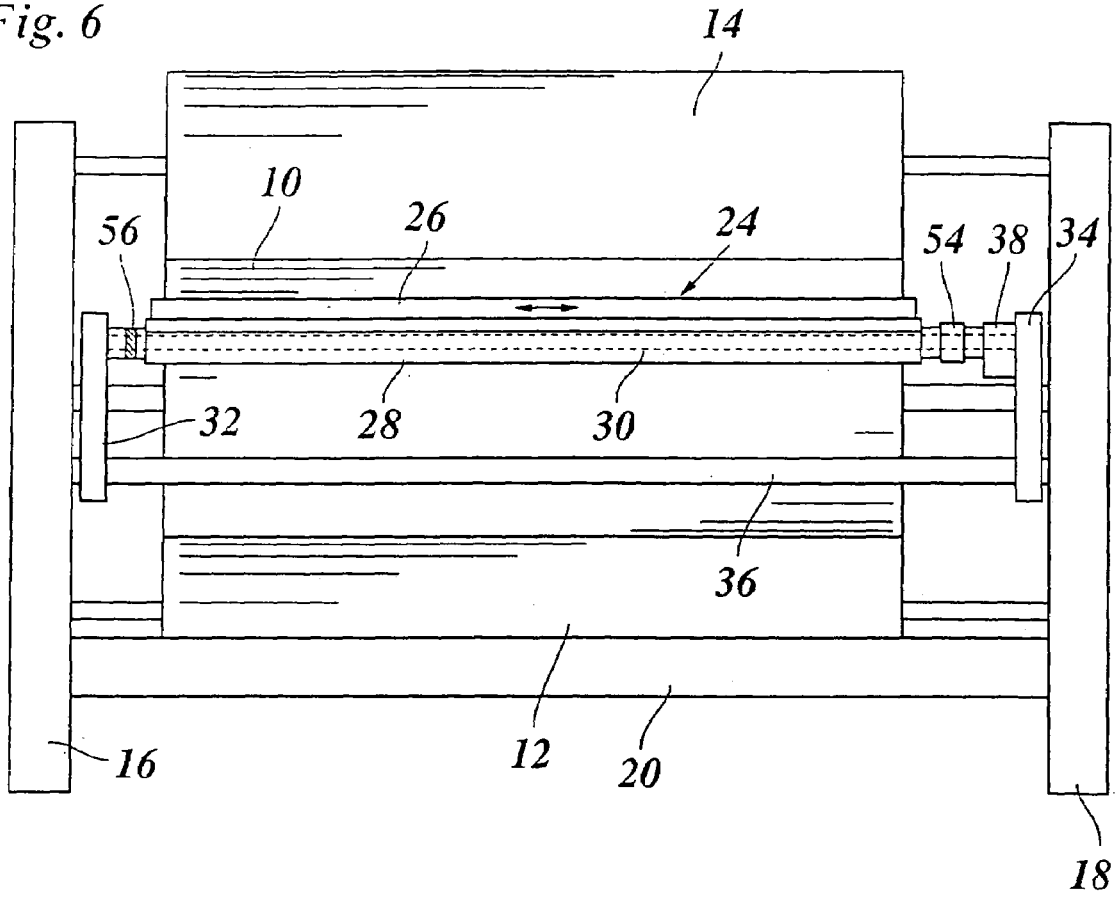
FIG. 6 is a schematic view of a gravure printing machine having a doctor blade assembly with oscillator.

FIG. 6 shows a gravure printing machine which has been modified in comparison to FIG. 1 in that an oscillator 54 has been inserted on the shaft 30 between the shift mechanism 38 and the bracket 28, the oscillator inducing high-frequency oscillations of the bracket 28 and hence the doctor blade 26 in the direction in parallel with the axis of the gravure printing cylinder 10, i.e. in parallel with the shift direction of the doctor blade 26. Thus the oscillator 54 forms another transverse displacement mechanism causing a vibration movement of the edge of the doctor blade 26, which vibration movement is superposed with the shift movement. The frequency of the vibration is in the ultrasonic range, so that the vibration oscillations of the doctor blade have the form of running ultrasonic waves, which propagate towards the opposite end of the doctor blade and are there absorbed by a damper 56 interposed between the lever 32 and the bracket 28.

However, the frequency may also be significantly smaller, and the oscillator 54 may be an acoustic oscillator, for example. Even a still smaller frequency of the vibration movement is possible. The stroke of the vibration movement may be very small and may for example amount to less than 0.2 mm.

Figure 7:
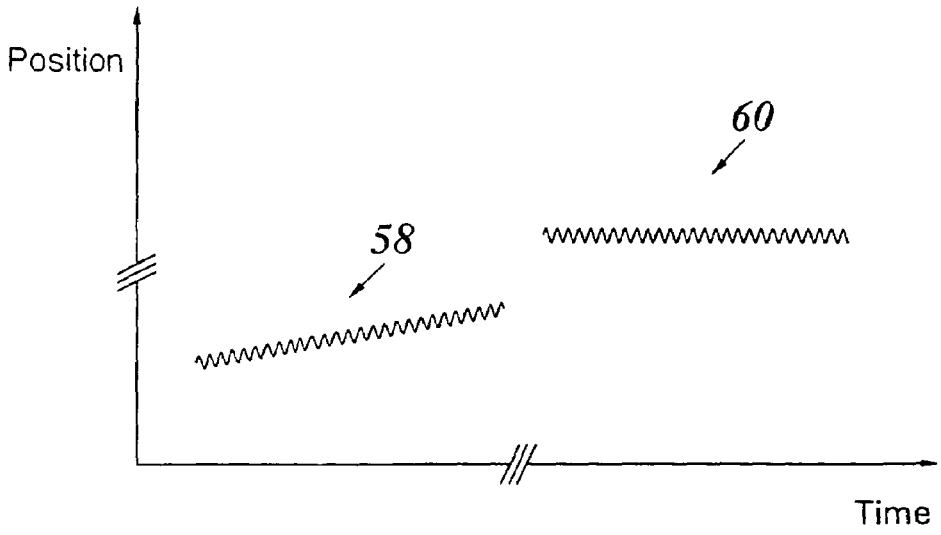
FIG. 7 is a diagram of phases of a periodic to-and-fro movement, to which a vibration movement is superposed.

FIG. 7 illustrates two phases of the shift movement of the doctor blade 26 according to FIG. 5, to which a vibration movement is superposed. In a phase 58 of the shift movement, the average position of the doctor blade 26 is gradually changed, while the doctor blade 26 simultaneously performs a vibration with a substantially smaller stroke about the average position. In a second phase 60, the shift movement changes direction. Here, the superposed vibration has the effect that a stationary condition of the doctor blade 26 does not occur, not even temporarily, at the reversal point of the shift movement. In comparison to the shift movement without superposed vibration, as shown in FIG. 5, the superposed vibration shown in FIG. 7 permits to further improve the print quality or, for a like quality, permits a higher shift velocity of the doctor blade.

The above embodiment examples relate to a gravure printing machine. However, the invention is applicable not only to gravure printing machines but also to other printing machines.

The invention claimed is:

1. A method for shifting a doctor blade in a longitudinal direction thereof, the doctor blade being set against a cylinder of a rotary printing machine of a type in which a printed web is wound on a coil which must be periodically changed, the method comprising the steps of:

shifting movement of the doctor blade such that, for most of the time of a print operation, a shift velocity of the doctor blade is in a range from 0 to 0.1 m/s, dividing the shift movement of the doctor blade, in terms of time, into motion preiods and rest periods such that, during the printing operation, the duration of the rest periods is predominant, and arranging the motion periods in operation phases in which a waste portion of the web is being printed.

2. Method according to claim 1, wherein the shift movement is a periodic to-and-fro movement with a period of at least 10 seconds.

3. Method according to claim 1, further comprising the step of superposing a vibration movement with a frequency of at least 1 Hz to the shift movement.

4. Method according to claim 1, wherein for most of the time of the print operation, the shift velocity of the doctor blade is in a range from 0 to 0.01 m/s.

5. Method according to claim 1, wherein the duration of the motion periods amounts to less than 10% of the duration of the rest periods.

6. Method according to claim 2, wherein the shift movement is a periodic to-and--fro movement with a period of at least 1 minute.

7. A rotary printing machine for performing the method according to claim 1 and having a doctor blade assembly and wherein a printed web is wound on a coil which must be periodically changed, the printing machine comprising:

a doctor blade arranged to be set against a cylinder, and a shift mechanism for shifting the doctor blade in its longitudinal direction, such that:

for most of the time of a print operation, a shift velocity of the doctor blade is in a range from 0 to 0.1 m/s, a shift movement of the doctor blade is divided, in terms of time, into motion periods and rest periods such that, during the printing operation, the duration of the rest periods is predominant, and the motion periods occur in operation phases in which a waste portion of the web is being printed.

8. A printing machine for performing the method according to claim 1 and having a doctor blade assembly, the printing machine comprising:

a doctor blade arranged to be set against a cylinder, and a shift mechanism for shifting the doctor blade in its longitudinal direction, such that for most of the time of a print operation, a shift velocity of the doctor blade is in a range from 0 to 0.1 m/s, an oscillator for generating a vibration movement of the doctor blade, and wherein the shift mechanism and the oscillator are adapted to execute an operation of at least one of:

superposing a vibration movement with a frequency of at least 1 Hz to the shift movement, and performing the vibration movement in the longitudinal direction of the doctor blade.

9. Method according to claim 3, wherein the vibration movement is superposed with a frequency of at least 5 Hz to the shift movement.

10. Printing machine according to claim 7 wherein the doctor blade has a ceramic coating on a side thereof that is exposed to wear.

11. Printing machine according to claim 7, wherein for most of the time of the print operation, the shift velocity of the doctor blade is in a range from 0 to 0.01 m/s.

12. Printing machine according to claim 7, wherein the duration of the motion periods amounts to less than 10% of the duration of the rest periods.

13. Printing machine according to claim 7, wherein the shift movement is a periodic to-and-fro movement with a period of at least 10 seconds.

14. Printing machine according to claim 13, wherein the shift movement is a periodic to-and-fro movement with a period of at least 1 minute.

15. A method for shifting a doctor blade in a longitudinal direction thereof, the doctor blade being set against a cylinder of a printing machine, comprising the steps of:

shifting movement of the doctor blade such that, for most of the time of a print operation, a shift velocity of the doctor blade is in a range from 0 to 0.1 m/s.

superposing a vibration movement with a frequency of at least 1 Hz to the shift movement, and performing the vibration movement in the longitudinal direction of the doctor blade.

* * * * *